US007416470B2

(12) United States Patent
Zarabi

(10) Patent No.: US 7,416,470 B2
(45) Date of Patent: Aug. 26, 2008

(54) UPPER BODY CONTROLLING AND SMOOTHING BODYSUIT

(76) Inventor: Robert Kambiz Zarabi, 20120 Plummer St., Chatsworth, CA (US) 91311

( * ) Notice: Subject to any disclaimer, the term of this patent is extended or adjusted under 35 U.S.C. 154(b) by 336 days.

(21) Appl. No.: 11/156,306

(22) Filed: Jun. 17, 2005

(65) Prior Publication Data

US 2006/0286899 A1 Dec. 21, 2006

(51) Int. Cl.
*A41C 1/06* (2006.01)
*A41B 9/00* (2006.01)

(52) U.S. Cl. ..... 450/22; 450/8; 2/78.3

(58) Field of Classification Search ..... 450/36, 450/39, 54–58, 7–11, 22–30; 2/73, 78.1–78.4
See application file for complete search history.

(56) References Cited

U.S. PATENT DOCUMENTS 1,622,873 A * 3/1927 Kops ..... 450/9
1,654,264 A * 12/1927 Kops ..... 450/9
1,659,281 A * 2/1928 Rigney et al. ..... 450/9
1,666,421 A * 4/1928 Krause ..... 450/4
1,978,092 A * 10/1934 Leonard ..... 450/9
2,009,620 A * 7/1935 Jackson ..... 450/28
2,115,146 A * 4/1938 Kops ..... 450/9
3,314,432 A * 4/1967 Erteszek ..... 450/31
3,947,207 A 3/1976 Magidson et al.
3,981,310 A 9/1976 Donaghy
4,154,249 A 5/1979 Darring
4,481,951 A * 11/1984 Cole et al. ..... 450/20
4,701,964 A 10/1987 Bell et al.
5,154,659 A 10/1992 Gluckin
5,447,462 A * 9/1995 Smith et al. ..... 450/122
5,507,681 A 4/1996 Smith et al.
5,820,445 A 10/1998 Smith et al.
5,907,872 A 6/1999 Alberts et al.
5,916,829 A 6/1999 Girard et al.
5,953,754 A 9/1999 Rosch et al.
5,984,762 A 11/1999 Tedeschi et al.
6,083,080 A 7/2000 Lawson et al.
6,115,847 A 9/2000 Rosch et al.
6,401,786 B1 6/2002 Tedeschi et al.
6,837,771 B2 * 1/2005 Falla ..... 450/39
6,966,815 B2 11/2005 Weinerth
2002/0023709 A1 2/2002 Tedeschi et al.
2002/0106970 A1 8/2002 Falla
2003/0220048 A1 11/2003 Toro et al.
2003/0232571 A1 12/2003 Weinerth
2004/0106354 A1 6/2004 Falla et al.
2005/0075046 A1 4/2005 Williams

* cited by examiner

*Primary Examiner*—Gloria Hale
(74) *Attorney, Agent, or Firm*—Blakely, Sokoloff, Taylor & Zafman LLP

(57) ABSTRACT

An undergarment or bodysuit which uses a simplex lining between a nylon like material outer layer and a cotton inner layer, the cotton inner layer and the simplex lining forming a laminate. Stabilized tricot may be included as part of the laminate. The use of the simplex layer instead of the foam layer results in a material which provides a similar smoothing effect as foam but which has a lower tendency to crease or ride up when the wearer bends down or bends over. Foam cushions are also provided at strategic places to reduce the pressure caused by flexible wires or bones used to provide additional support to keep the bones from digging into the rib cage and provide more comfort to the bodysuit undergarment.

8 Claims, 2 Drawing Sheets

UPPER BODY CONTROLLING AND SMOOTHING BODYSUIT

BACKGROUND OF THE INVENTION

1. Field of the Invention

This invention relates generally to upper bodysuits or undergarments, and more particularly, to bodysuits or undergarments of the type which serve to shape the upper body, and provide control to the waist and tummy of female wearers of strapless gowns and the like.

2. Description of the Related Art

Many types of undergarments are known in the prior art which are constructed to provide support to the user. See, for example U.S. Pat. No. 4,154,249. Although the prior art devices generally serve their intended purpose, they usually are made of a single layer of non stretchable fabric and have a number of vertically extending seams and/or bones or wires which extend the length of the front portion of the garment. These wires and/or seams tend to result in visible lines which appear when wearing thin, tight fitting gowns or the like. Typically, prior art undergarments do not have vertically extending wires at the rear. Moreover, although products are available which utilize a foam construction which do not suffer this problem, for example, Style No. 7643 available from Felina Lingerie, such products tend to ride up or form creases in the midriff area when the wearer bends down or bends over. This problem results from the use of a TACTEL (a type of yarn and registered trademark) outer layer and a foam and cotton backing laminate as the inner layer because the foam layer tends to compress and stretch when put under pressure.

SUMMARY OF THE INVENTION

The present invention overcomes the limitations of the prior art by virtue of several improvements. First, instead of using a foam and cotton backing laminate as in inner layer for the front portion of the garment, the invention uses a simplex lining between the TACTEL outer layer and the cotton inner layer, the cotton inner layer and the simplex lining forming a laminate. Stabilized tricot may be included as part of the laminate. The use of the simplex layer instead of the foam layer results in a material which provides a similar smoothing effect as foam but which has a lower tendency to crease or ride up when the wearer bends down or bends over. Foam cushions are also provided at strategic places to reduce the pressure caused by flexible wires or bones used to provide additional support. That is, the foam cushions keep the bones from digging into the rib cage and provide more comfort to the bodysuit undergarment.

DETAILED DESCRIPTION OF THE INVENTION

Figure 1:
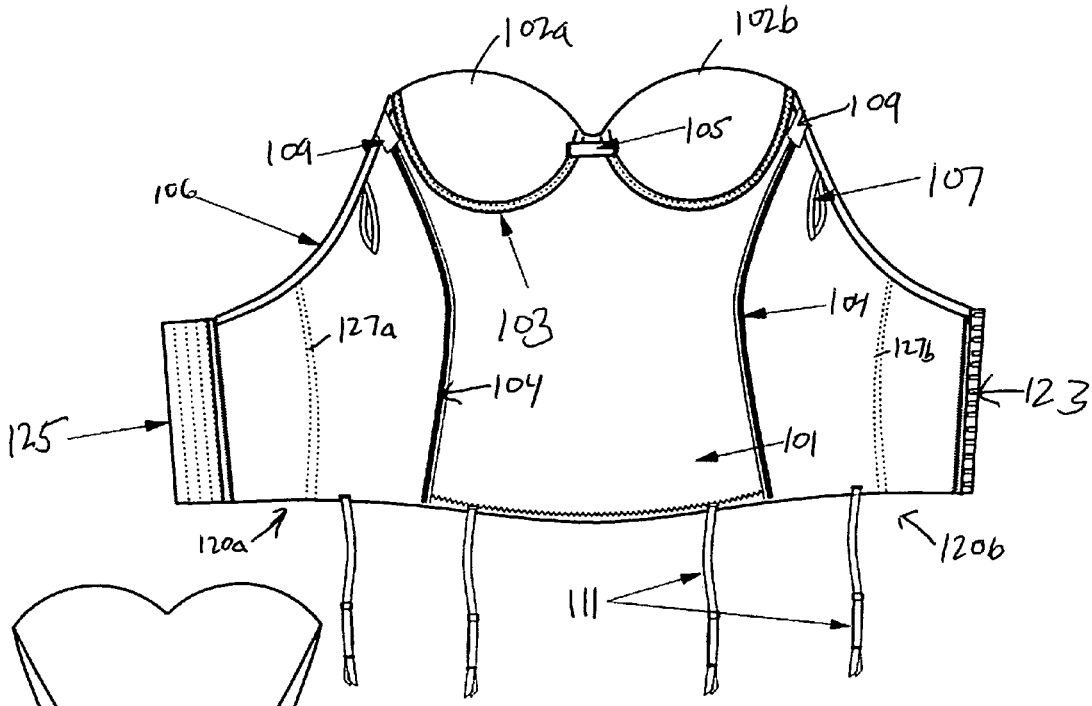
FIG. 1 is a front elevation view showing an undergarment in accordance with the invention.

Referring first to FIG. 1, the invented undergarment comprises front body portion 101, cup portions 102*a* and 102*b*, and rear body portions 120*a* and 120*b*. As is typical in the art, rear body portions include hooks 123 and eyes 125 which engage one another when the undergarment is being worn. As is also typical in the art, there exists more than one column of eyes so that adjustments can be made for size differentials.

Also as is typical in the art, the undergarment includes flexible metal wires sometimes referred to as bones. In the case of the cups, flexible wires 103 are curved and are located on the underside of the cups to provide lift. Side flat bone space gage 104 plushed channeling, over lock to the side which once worn gets hidden away while wearing so that the seam does not show, strengthens the side seams and adds to comfort. Foam cushion 109 provides protection from pressure exerted by the ends of wires 104 when the undergarment is being worn.

Flexible wires 127*a* and 127*b* extend the length of the garment and are located so that they are approximately centered with respect to first and second rear body portions 120*a* and 120*b*. Foam padding 106 is added to provide a cushion to protect from pressure exerted by wires 127*a* and 127*b* when the undergarment is being worn. The various flexible wires exist to provide additional support for the wearer. Side hooks 107 are used to hang the garment on a hanger.

Figure 2:
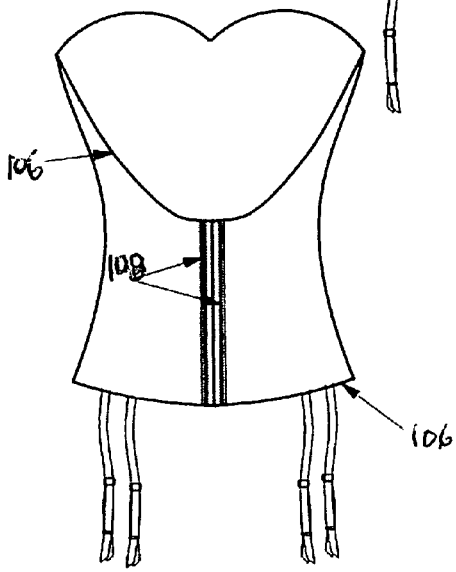
FIG. 2 is a rear elevation view showing an undergarment in accordance with the invention.

FIG. 2 is an illustration of the undergarment shown from the rear in the worn position. Flexible wires 108 extend the length of the rear body portions adjacent to hooks 123 and eyes 125 respectively to provide additional posture control and support.

Figure 3:
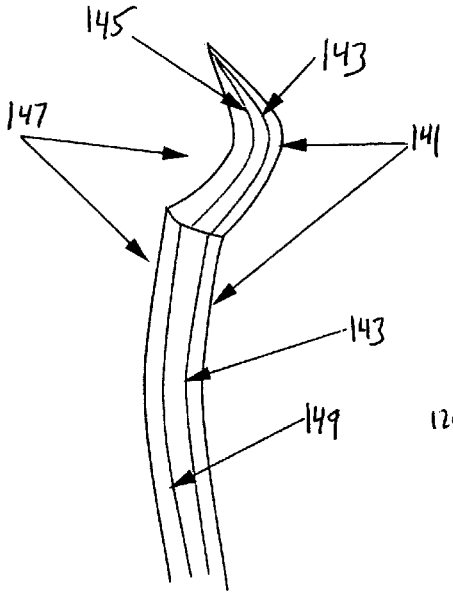
FIG. 3 is a side elevation view showing in detail the layers of fabric used in accordance with the invention.

Referring to FIG. 3, cup portions 102*a* and 102*b* (from FIG. 1) includes an outer layer made of TACTEL fabric 141 or other comparable fabric which is thin, lightweight and stretchable. Adjacent the outer layer is a second layer 143 of simplex fabric or other comparable fabric which is thin, light and does not stretch. The cups also include a foam layer 145 adjacent the simplex fabric. Finally, there is inside cotton layer 147 one side of which is adjacent the foam layer and the other side of which lies against the body when the undergarment is worn. Except for the TACTEL layer, the remaining layers form a laminate.

Front body portion 101 also includes an outer layer of TACTEL fabric 141 or other comparable fabric. Adjacent this outer layer is a second layer of simplex fabric 143 or other comparable fabric. Adjacent simplex layer 143 is a third layer of stabilized tricot 149. Front body portion 101 also includes an inside lining of cotton fabric 147 adjacent the tricot layer which lies against the body when the undergarment is worn. Except for the outer layer, the remaining layers form a laminate.

Figure 4:
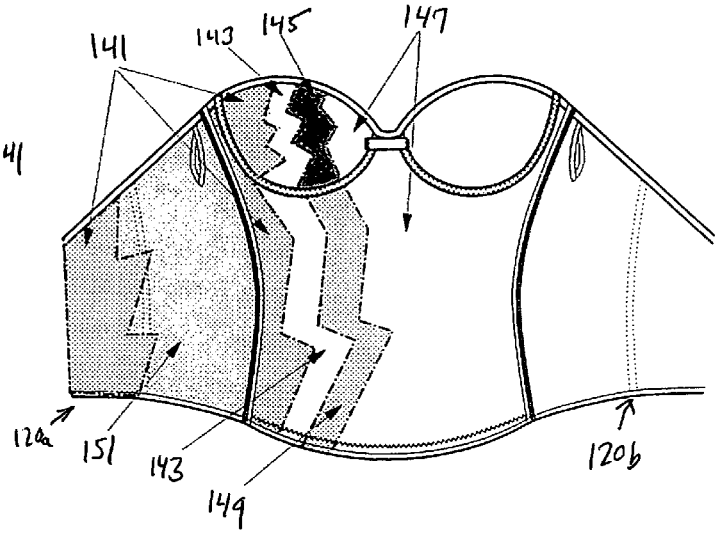
FIG. 4 is a front elevation view showing in detail the layers of fabric used in accordance with the invention.

As best seen in FIG. 4, front body portion 101 and cup portions 102*a* and 102*b* are similar excepting that the cup portions include a foam layer 145 while the front body portion instead utilizes a layer of stabilized tricot fabric. Rear body portions 120*a* and 120*b* have an outer layer of TACTEL fabric 141 and an inner layer of powernet fabric 151. The various layers are laminated together excepting for the outer layer which is connected to the seams joining the various parts of the undergarment.

By virtue of the above-described construction, the present invention provides certain advantages which are not available in the prior art. In particular, the simplex fabric layer 143 results in a very light smooth lining center for the front body portion 101 which will not crease while providing control and a hip lining which has some give. There is no seaming on the outer layer which provides for a very smooth appearance for even very tight fitting outer garments. The undergarment may be worn with strapless dresses while providing a desirable push-up effect with a smooth all-around appearance. Contour pads or push up pads may also be included if desired. The thong portions 109*a* and 109*b* anchors the garment and prevents the garment from riding up when the wearer bends or stretches.

The specifics regarding the manufacture of the garment as described above are well within the abilities of persons skilled in the art. As to the various fabrics, appropriate sources are also well known for suitable TACTEL fabric, simplex fabric, stabilized tricot and powernet or equivalents are available from a variety of well known sources. Similarly, the flexible wires, foam, cotton backing and laminates are all very well known components available from many sources.

The invention claimed is:

1. A woman's undergarment comprising:

a) first and second cup portions, each including a cup outer layer, and a cup inner layer;

b) a front body portion coupled to and extending from said cup portions including a body outer layer, and a body inner layer;

c) first and second rear body portions each coupled to said front body portion at side semas;

wherein said cup inner layer and said body inner layer comprise a fabric which is thin, lightweight and does not stretch and said cup outer layer and said body outer layer comprise a fabric which is thin, light weight and stretchable; and d) a flexible metal bone vertically disposed between said first and second cup portions.

2. A woman's undergarment comprising:

a) first and second cup portions, each including a cup outer layer, and a cup inner layer;

b) a front body portion coupled to and extending from said cup portions including a body outer layer, and a body inner layer;

c) first and second rear body portions each coupled to said front body portion;

wherein said cup inner layer and said body inner layer comprise a fabric which is thin, lightweight and does not stretch and said cup outer layer and said body outer layer comprise a fabric which is thin, light weight and stretchable; and d) comprising first and second flexible metal bones disposed between said front body portion and each of said first and second rear body portions, each of said metal bones extending the length of the front body portion and foam padding adjacent one end of each of said flexible metal bones.

3. A woman's undergarment comprising:

a) first and second cup portions, each including a cup outer layer, and a cup inner layer;

b) a front body portion coupled to and extending from said cup portions including a body outer layer, and a body inner layer;

c) first and second rear body portions each coupled to said front body portion at side seams;

wherein said cup inner layer and said body inner layer comprise a fabric which is thin, lightweight and does not stretch and said cup outer layer and said body outer layer comprise a fabric which is thin, light weight and stretchable; and d) wherein said front body portion further comprises a cotton layer one side of which is adjacent the inner layer and the other side of which lies against the body when the undergarment is worn, the inner layer and cotton layer forming a laminate.

4. A woman's undergarment comprising:

a) first and second cup portions, each including a cup outer layer, and a cup inner layer;

b) a front body portion coupled to and extending from said cup portions including a body outer layer, and a body inner layer;

c) first and second rear body portions each coupled to said front body portion at side seams;

wherein said cup inner layer and said body inner layer comprise a fabric which is thin, lightweight and does not stretch and said cup outer layer and said body outer layer comprise a fabric which is thin, light weight and stretchable; and d) further comprising a pair of flexible wires which extend the length of the rear body portions adjacent to hooks and eyes respectively to provide additional support, said hooks and eyes adapted to engage each other when the undergarment is worn.

5. The undergarment defined by claim 1 wherein there is no seaming on the body outer layer.

6. The undergarment defined by claim 2 wherein there is no seaming on the body outer layer.

7. The undergarment defined by claim 3 wherein there is no seaming on the body outer layer.

8. The undergarment defined by claim 4 wherein there is no seaming on the body outer layer.

* * * * *